US008555766B2

(12) United States Patent
Garrett et al.

(10) Patent No.: US 8,555,766 B2
(45) Date of Patent: Oct. 15, 2013

(54) SAFE AND ARM SYSTEM FOR A ROBOT

(75) Inventors: David G. Garrett, Tucson, AZ (US); Todd A. Isaac, Newburgh, IN (US)

(73) Assignee: Raytheon Company, Waltham, MA (US)

( * ) Notice: Subject to any disclaimer, the term of this patent is extended or adjusted under 35 U.S.C. 154(b) by 119 days.

(21) Appl. No.: 13/100,560

(22) Filed: May 4, 2011

(65) Prior Publication Data

US 2012/0279382 A1 Nov. 8, 2012

(51) Int. Cl.
*F41A 19/00* (2006.01)

(52) U.S. Cl.
USPC ..... 89/27.12

(58) Field of Classification Search
USPC ..... 89/1.1, 27.12; 42/70.01
See application file for complete search history.

(56) References Cited

U.S. PATENT DOCUMENTS 2,948,192 A 8/1960 Evans et al.
5,327,810 A * 7/1994 Sandusky et al. ..... 89/27.3
7,143,696 B2 * 12/2006 Rudakevych et al. ..... 102/215
7,974,736 B2 * 7/2011 Morin et al. ..... 700/245
8,127,482 B2 * 3/2012 O'Shaughnessy et al. .. 42/70.11
8,375,838 B2 * 2/2013 Rudakevych et al. ..... 89/27.11
8,448,557 B2 * 5/2013 Hamish et al. ..... 89/27.12
2004/0249508 A1 12/2004 Suita et al.
2007/0204745 A1 9/2007 Son et al.
2008/0083344 A1 4/2008 Deguire et al.

* cited by examiner

*Primary Examiner* — Gabriel Klein
(74) *Attorney, Agent, or Firm* — Renner, Otto, Boisselle & Sklar, LLP

(57) ABSTRACT

A system (10) for remotely enabling and disabling a weapon (12), includes a watchdog controller (14) adapted to receive a safe/arm command from a remote source (16) and to transmit the safe/arm command if predetermined conditions are satisfied, a safe/arm controller (20) adapted to receive the safe/arm command from the watchdog controller (14) and to transmit a control signal to enable communication between a weapon system processor (24) and the weapon (12) if a predetermined series of input signals are received in a predetermined sequence. The system also includes a switch (22) in a communication path between the weapon system processor (24) and the weapon (12). The safe/arm controller (20) closes the switch (22) and enables communication between the weapon system processor (24) and the weapon (12) only when the safe/arm controller (20) receives an arm signal and receives the predetermined series of input signals in the predetermined sequence.

17 Claims, 3 Drawing Sheets

SAFE AND ARM SYSTEM FOR A ROBOT

FIELD OF THE INVENTION

This invention relates to safe and arm systems for a remotely controlled robot, and, more particularly, to safe and arm systems for robotic or remotely controlled weapons.

BACKGROUND

Safe and arm systems for weapons, including, guns, explosives, etc., are well known and typically require the activation of more than one switch, detection of one or more environmental conditions, and/or the use of special keys or codes before firing the weapon. Most weapons include a safety mechanism to prevent the weapon from discharging accidentally. These safety mechanisms can be built into the weapon or provided as an accessory, such as a trigger lock.

Robotic devices and remote systems are being used for border security and other specialized tasks. The use of mobile robotic systems, in particular, is increasing. In many industrial robots, electronic safety systems typically are employed to prevent inadvertent operation of the robot that could injure the operator.

Remotely controlled weapons mounted on or integrated into robotic systems pose significant hazards, including accidental weapon discharge, uncontrolled or unexpected discharge due to failures in the hardware or software, etc., that could proved harmful to operators and maintainers of these weapons.

SUMMARY OF THE INVENTION

The present invention provides a simple, effective system and method for providing the same or greater level of safety for weapons controlled from a remote location as compared to present day handheld or manually activated weapons. The present invention provides a quick response time, allowing a human operator to maintain positive control over the weapon's safe/arm state. In addition, robotic weapons systems can be built with this invention without software in the safety critical path. The absence of safety critical software eliminates a large expense and also reduces the cost of system development and maintenance.

More particularly, the system and method provided by the present invention incorporate a safety watchdog sequencer and antifuse technologies. The safety watchdog has positive control over the weapon's controls such that it can enable or disable all weapon functions. The safety watchdog cannot discharge a weapon by itself, however. The safety watchdog enforces a specific sequence of actions to load and power up the system. The sequence can be customized for a specific weapon and system requirements. This ensures operator safety during operation of the weapon, particularly when the operator is required to be in close proximity to the weapon. The safety watchdog incorporates a remote "dead man" switch and system health monitoring functions to ensure the integrity of the system. If the safety watchdog detects an out-of-nominal condition, it disables the weapon control system, rendering the system safe. While watchdogs can ensure operator safety by themselves, they cannot provide complete operational safety.

In combination with the safety watchdog, an antifuse provides the electronic equivalent of a mechanical safe/arm switch commonly found on light arms, such as handguns and other handheld weapons. With a handgun the safety is provided by trigger locks and other safety mechanisms. The antifuse in the system provided by this invention is incorporated into the weapon in such a way that it provides a remote operator the same safe/arm capability the operator would have if the weapon were in his hand. This is accomplished by use of complex arming codes and close coupling of the antifuse arming sequence with the safety watchdog. The safety watchdog and antifuse override and/or interrupt the weapon functionality such that without multiple system failures the software in the robotic controls cannot discharge the weapon unless the operator has deemed it safe to do so. This effectively removes the system software from the safety critical path.

The system provided by the present invention thus uses an antifuse as a gun trigger safe/arm switch, and a watchdog provides independent system safety to enforce safe operation of a robotic weapon. Finally, the safety watchdog and antifuse remove robotic control software from the system's safety-critical path. Unlike previous designs, the system provided by the present invention provides remote control operations, prevents a single point failure alone from resulting in an unsafe operation, and allows the robot to be disabled separately from the weapon system.

One system provided by the invention for remotely enabling and disabling a weapon, includes (a) a watchdog controller adapted to receive a safe/arm command from a remote source and to transmit the safe/arm command if predetermined conditions are satisfied; (b) a safe/arm controller adapted to receive a coded safe/arm command from the watchdog controller and to transmit a control signal to enable communication between a weapon system processor and the weapon if a predetermined series of input signals are received in a predetermined sequence; and (c) a switch in a communication path between the weapon system processor and the weapon. The safe/arm controller closes the switch and enables communication only when the safe/arm controller receives an arm signal and receives the predetermined series of input signals in the predetermined sequence.

The system generally works with, and can include a remote input device to send a safe/arm command to the watchdog controller. The system also generally works with, and can include a remote weapon system processor adapted to output a status signal to the watchdog controller and to output a control signal to control the weapon.

In an exemplary embodiment, the safe/arm controller includes a hardwired antifuse circuit.

The present invention also provides a method for remotely controlling a weapon system. The method includes the following steps: (a) providing a safe state where the weapon cannot discharge; (b) moving the weapon from a safe state to a ready-to-fire state only if a predetermined sequence of events occurs in the proper order; and (c) discharging the weapon only in the ready-to-fire state. The moving step requires both that the weapon system processor and the safe/arm control system are in predetermined operational states and that they receive a remote weapon arm signal.

Similarly, the present invention provides as method for remotely enabling a weapon to discharge. This method includes the following sequence of steps: (i) receiving a status signal from a remote source; (ii) determining that the weapon is in a safe condition; (iii) receiving a status signal from a weapon system processor; (iv) receiving a safe/arm signal from a remote source; and (v) transmitting the safe/arm signal to a safe/arm controller.

The method can further include the following step after the transmitting step (v): (vi) changing the state of a switch from a safe state to an arm state to close a communication path between the weapon system processor and the weapon, thereby allowing the weapon system processor to discharge the weapon.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

The system and method provided by the present invention incorporate a safety watchdog and antifuse technologies into a control system for a remotely controlled robot, particularly one armed with a weapon. The safety watchdog has positive control over communications with the weapon's controls such that it can enable or disable all weapon functions. The safety watchdog enforces a specific sequence of actions to load and power up the system. The safety watchdog enforces the presentence of specific environments or conditions before the system powered up and/or enabled. The sequence can be customized for a specific weapon and system requirements. The safety watchdog cannot discharge a weapon by itself, however. This ensures operator safety during operation of the weapon, particularly when the operator is required to be in close proximity to the weapon. The safety watchdog incorporates a remote "dead man" switch and system health monitoring functions to ensure the integrity of the system. If the safety watchdog detects an out-of-nominal condition, it disables the weapon control system, rendering the system safe. While watchdogs often can ensure operator safety by themselves, they cannot provide complete operational safety.

In combination with the safety watchdog, an antifuse controller provides the electronic equivalent of a mechanical safe/arm switch commonly found on light arms, such as handguns and other handheld weapons. With a handgun the safety is provided by trigger locks and other safety mechanisms. The antifuse in the system provided by this invention is incorporated in such a way that it provides a remote operator the same safe/arm capability the operator would have if the weapon were in his hand. A weapon system controller controls operation of the weapon, but only if permitted to do so by both the watchdog and the antifuse. The safety watchdog and antifuse override and/or interrupt the weapon functionality such that without multiple system failures the software in the robotic weapon system processor cannot discharge the weapon unless the operator has deemed it safe to do so. This effectively removes software in the weapon controller from the safety-critical path.

The system provided by the present invention thus uses an antifuse as a gun trigger safe/arm switch, and a watchdog provides independent system safety oversight to enforce safe operation of a robotic weapon. Finally, the safety watchdog and antifuse remove robotic control software from the system's safety-critical path. Unlike previous designs, the system provided by the present invention provides remote control operations, prevents a single point failure alone from resulting in an unsafe operation, and allows the robot to be disabled separately from the weapon system.

Figure 1:
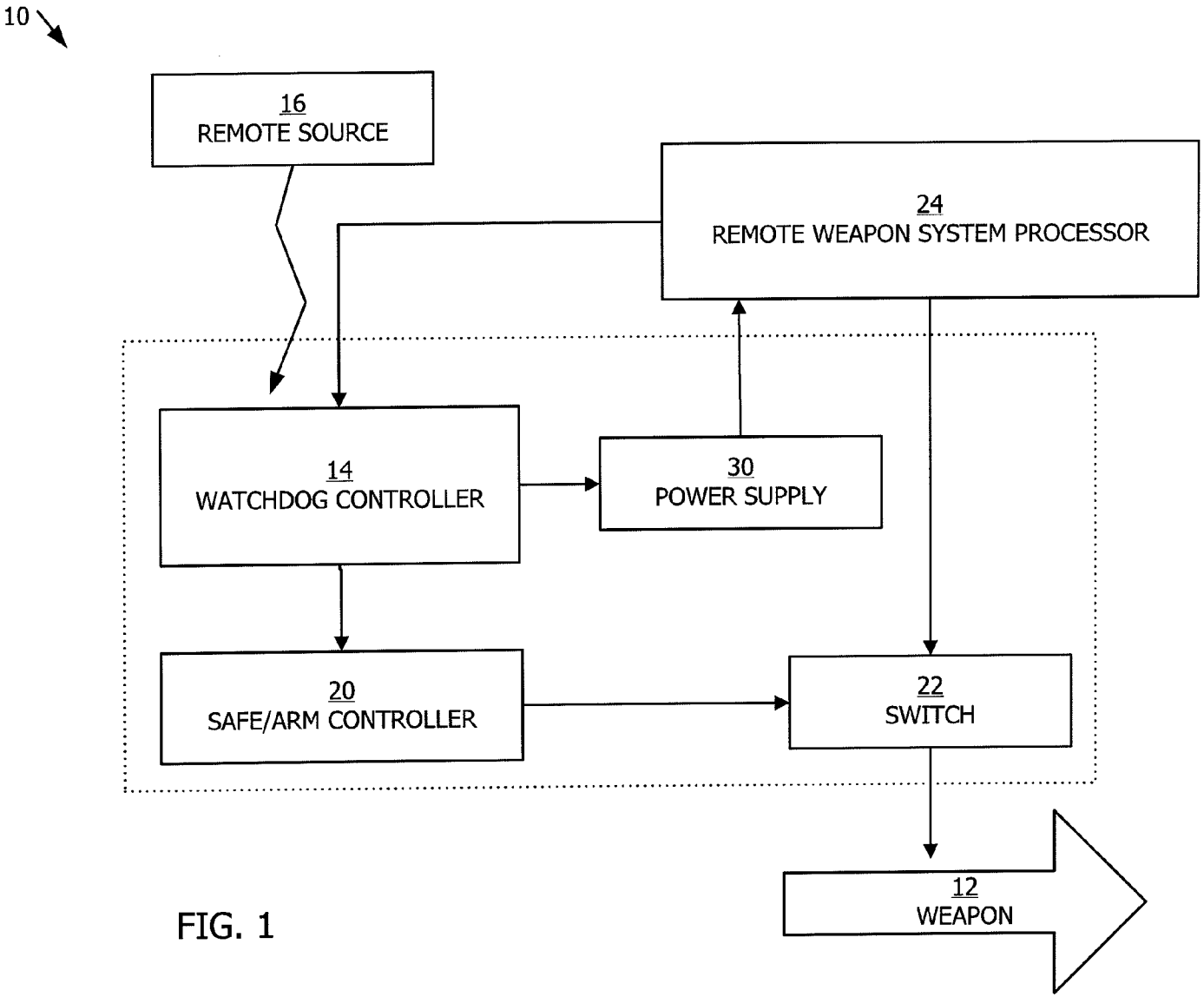
FIG. 1 is a schematic design of a system that incorporates the present invention.

An exemplary system 10 for remotely enabling and disabling a weapon 12 is shown schematically in FIG. 1. The system 10 includes a watchdog controller 14 adapted to receive a safe/arm command from a remote source 16 and to transmit the safe/arm command if predetermined conditions are satisfied, and a safe/arm controller 20 adapted to receive the safe/arm command from the watchdog controller 14 and to transmit a control signal to enable communication between a weapon system processor 24 and the weapon 12 if a predetermined series of input signals are received in a predetermined sequence.

The remote weapon system processor 24 generally controls the weapon 12, which can include means for tracking, arming, and firing or otherwise discharging the weapon. Discharging the weapon can include actuating a trigger to fire a bullet, to launch a missile or other projectile, or arming an explosive, such as by initializing a detonator or an igniter, for example.

The remote weapon system processor 24 is adapted to output one or more status signals to the watchdog controller 14 and to output one or more control signals to operate the weapon 12. The system also includes a switch 22 in a communication path between the weapon system processor 24 and the weapon 12. The safe/arm controller 20 closes the switch 22 and enables communication between the weapon system processor 24 and the weapon 12 only when the safe/arm controller 20 receives an arm signal from the watchdog controller 14, which it can do only if it receives the predetermined series of input signals in the predetermined sequence.

The system 10 also includes a remote input device 16. The remote input device 16 includes a deadman switch that controls transmission of a heartbeat signal wirelessly transmitted to the watchdog controller 14. The deadman switch must be held to maintain the heartbeat signal. The watchdog controller 14 also receives a safe/arm command from the remote source 16, typically, but not necessarily, the same remote source that controls the remote heartbeat signal. The safe/arm command tells the watchdog controller 14 whether to arm the weapon 12 or to place the weapon 12 in safe condition where the weapon 12 is prevented from discharging. The watchdog controller 14 transmits a safe/arm command to the safe/arm controller 20 based on the safe/arm command from the remote source 16.

The safe/arm controller 20 preferably includes a hardwired antifuse circuit. An antifuse circuit has its programming hardwired into its structure. Thus, once it is programmed its programming cannot be changed without changing its physical structure. An exemplary safe/arm controller 20 includes an antifuse field-programmable gate array.

In contrast to the safe/arm controller 20, the watchdog controller 14 typically is software programmable such that its programming can change by changing its software code. The watchdog controller 14 is adapted to receive and/or monitor predetermined conditions that include one or more of a heartbeat signal from the remote source 16, a heartbeat signal from the weapon system processor 24, a power signal, a weapon status signal, and a safe/arm signal from the remote source 16. The watchdog controller 14 controls the power to and the power sequencing of the system processor 24 via the power controller 30. This insures the power up processes in the system controller 24 can not operate or discharge the weapon 12 as a result of details of the circuitry operation during the power on or power off transients of the system controller 24.

A command to discharge a weapon 12 cannot be communicated to the weapon 12 unless the safe/arm controller 20 permits the command signals from the remote weapon system processor 24 to pass the switch 22 to the weapon 12. The switch 22 is normally open, thereby blocking signals from the weapon system processor 24 to the weapon 12 in the event of a loss of power to the safe/arm controller 20. The safe/arm controller 20 must receive a coded message from the remote source 16, typically via the watchdog controller 14 as in the exemplary system 10 or by another path. The coded message content is not incorporated directly into the watchdog controller 14, so that a fault in the watchdog controller can not issue an unintended arm message to the safe/arm controller 20.

Figure 2:
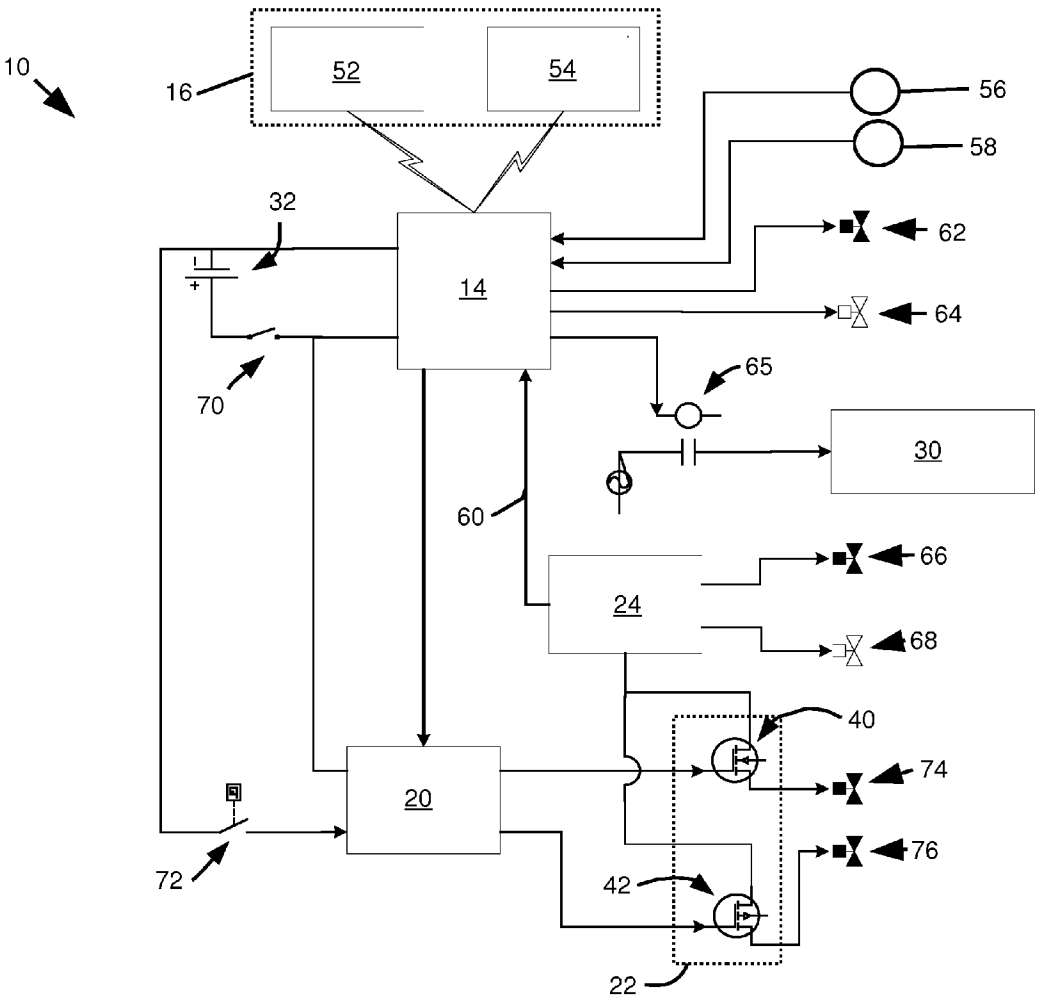
FIG. 2 is a schematic illustration of a portion of an exemplary embodiment of the system shown in FIG. 1.

FIG. 2 illustrates in more detail features of an exemplary system 10 provided in accordance with the present invention. In this embodiment, the system 10 includes an input device 16 that provides a wireless signal to the watchdog controller 14. The input device 16 includes a component for transmitting a remote heartbeat signal 52 as well as a component for transmitting a safe/arm command 54. The watchdog controller 14 receives both the remote heartbeat signal and the remote safe/arm command.

The system 10 includes a watchdog power supply 32 that provides electrical power to the watchdog controller 14. The remote weapon system processor 24 has a power supply 30 that is independent of a power supply 32 for the watchdog controller 14. The safe/arm antifuse controller 20 uses the same power supply 32 as the watchdog controller 14, but the watchdog controller 14 controls whether power is provided to the safe/arm controller 20 with switch 70. Alternatively, the safe/arm controller 20 can have its own power supply.

The watchdog controller 14 also receives status inputs or signals 56 and 58 from sensors or other devices, including a logic signal input 56 that is high, for example, five volts, if a chamber in a weapon is empty and another logic signal input 58 with a high value if the weapon is not cocked and ready to fire. The watchdog controller 14 also receives a heartbeat or status signal 60 from the weapon control system processor 24.

The system 10 illustrated in FIG. 2 includes a pneumatic control circuit connected to the watchdog controller 14, the remote weapon system processor 24 and the safe/arm controller 20. Thus, the communication path between the weapon system processor 24 and the weapon 12 is pneumatic in this embodiment. Other types of control circuits, such as an electro-mechanical circuit, can be used in place of the pneumatic control circuit in other embodiments provided by the invention. Accordingly, the switch 22 between the weapon system processor 24 and the weapon 12 is an electrically-operated pneumatic valve. The watchdog controller 14 controls a pair of valves, one of which 62 is normally closed and must be held open to supply pressure to the system or to cut off pressure if power is lost and the cutoff valve 62 is allowed to close. The other valve 64 is normally open and will vent pressure, and therefore must be held closed for operation. The watchdog controller 14 also controls a relay 65, which is normally open and must be held closed to provide electrical power from a weapon system processor power supply 30 to the weapon system processor 24. The watchdog controller 14 can be configured such that a command to close relay 65 can be provided from the remote input device 16, allowing an operator to withdraw from the vicinity of the weapon 12 before power is applied to the system controller 24.

The weapon system processor 24 also controls two valves, one of which 66 is normally closed and must be held open for operation or it will cut off pressure to the system. The other valve 68 is normally open and must be held closed for operation to prevent the pressure from being vented.

A pair of switches control the supply of power to the safe/arm controller 20. The first switch 70 is a manual switch closed by an operator to provide power to the safe/arm controller 20 as well as the watchdog controller 14. If the manual switch 70 is opened, power is cut to all of the components in the system 10. The second switch 72, which also must be closed to provide power to the safe/arm controller 20 is a pressure switch to provide power to the safe/arm controller 20. The application of pressure to pressure switch 72 is controlled by the watchdog controller 14 by means of valves 62 and 64 and by the system processor 24 by means of valves 66 and 68.

The switch 22 in this embodiment, controlled by the safe/arm controller 20, is provided by a pair of transistors 40 and 42. The safe/arm controller 20 transmits a high-voltage signal to a negative channel field effect transistor (NFET) 40 and a low voltage signal to a positive channel field effect transistor (PFET) 42. Closing the switch 22 completes the communication path from the weapon system processor 24 to the weapon 12, which includes the devices that control the weapon 12.

The switch 22 in this embodiment controls a pair of valves 74 and 76. The valves shown are normally-closed valves, which can be opened to permit the remote weapon system processor 24 to control a trigger actuator, for example (not shown). Both valves 74 and 76 must be held open for the actuator to pull the trigger and discharge the weapon. These valves 74 and 76 can only be opened with a combination of the signals from the safe/arm controller 20 and a control signal from the weapon system processor 24. The safe/arm controller 20 will only provide the appropriate signal based on a safe/am signal from remote input device 16 via the watchdog controller 14.

The switch 22 also can be considered as including both an NFET 40 and a PFET 42, as well as a pair of normally-closed valves 44 and 46 that are opened in response to an "arm" signal from the remote input device 16 via watchdog 14 to the safe/arm controller 20. Alternatively, the switch 22 can include at least two valves 44 and 46, one of which is normally open and one of which is normally closed. Both the normally-open valve 44 must be closed and the normally-closed valve 46 must be opened to transmit a control signal from the remote weapon system processor 24 to the weapon 12. Other variations are within the scope of the present invention.

Figure 3:
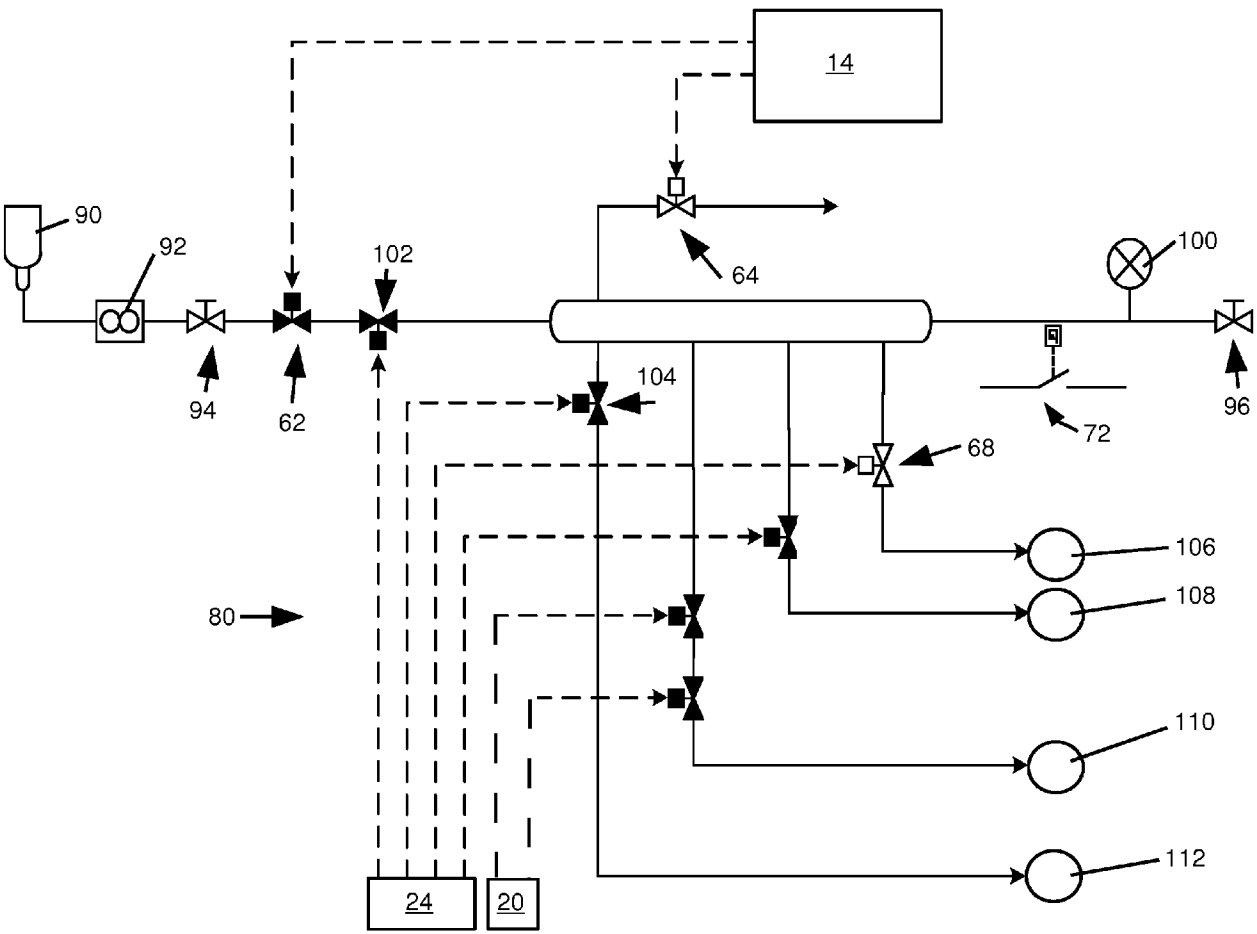
FIG. 3 is a schematic illustration of a portion of an exemplary embodiment of the system shown in FIG. 1.

FIG. 3 illustrates further details for an exemplary pneumatic control system 80. The watchdog controller 14 is connected to the pneumatic control system 80 to provide control signals to the normally-closed cutoff valve 62 and the normally-open vent valve 64 to pressurize or depressurize the lines in the pneumatic control system 80. A supply of pressurized gas 90 is provided to supply pressurized gas to the control lines. The supply 90 is connected to a pressure regulator 92 and a manual cutoff valve 94 in series. The system 80 also includes a manual venting valve 96 and a visual pressure indicator or gauge 100. Closing a normally-open pressure switch 72 provides power to the safe/arm controller 20. As described in the previous figure, valve 68 is normally open and vents pressure from the control system 80 if not closed, as does the vent valve 64 controlled by the watchdog controller 14. Valve 68 is controlled by the weapon system processor 24. The weapon system processor 24 also controls a normally-closed valve 66. Opening this valve 66 pressurizes a device that acts on the weapon, for example loading the weapon or otherwise preparing the weapon to discharge. The weapon system processor 24 also controls a normally-closed cutoff valve 102, in-line with the normally-closed valve 62 controlled by the watchdog controller 14. Consequently, both valve 62 and valve 102 must be held open to maintain pressure in the control system 80.

The weapon system processor 24 also controls a normally-closed valve 104 that controls another device 112 that acts on the weapon, such as actuating a selector switch to select between a single shot or rapid semiautomatic firing. As previously noted, the safe/arm controller 20 also controls a pair of normally-closed valves to activate the trigger actuator 110.

A pneumatic control system 80 such as this provides a number of advantages. Namely, it avoids power-up issues associated with servomechanisms, it simplifies electromagnetic interference issues, and all valves can be biased to a safe position such that a power loss moves the system into a safe condition automatically. Although not shown, an alternative control system could be electro-mechanical rather than pneumatic, and if properly designed also could overcome some of the issues of a servomechanism.

If pressure drops in the pneumatic control system 80 or the safe/arm controller 20 receives a safe signal or the system 10 loses power, etc., the watchdog controller 14 will shut everything down and move the system into a safe mode. The paired or duplicate valves and switches employed throughout this system 10 ensure that a single point failure will not lead to a system malfunction, such that a weapon cannot discharge if one component fails.

As noted previously, the watchdog controller 14 controls the pneumatic control system pressure, ensures that the pressure is off while the weapon control system processor 24 is powering up, depressurizes the pneumatic control system 80 if the weapon control system processor 24 fails, and also depressurizes the pneumatic control system 80 if the remote heartbeat signal from the input device 16 (FIG. 1) is interrupted due to opening of the dead man switch or other loss of signal. In this example, the trigger actuator is activated with redundant valves such that at least two failures must occur to cause an unintended discharge of the weapon.

The safe/arm controller 20 is used as an electronic safety. The safe/arm controller 20 forces the system 10 to a safe position until the pneumatic control system 80 is pressurized. The safe/arm controller 20 preferably also includes or incorporates a time delay after the pneumatic system 80 is pressurized before the weapon can be armed. The safe/arm controller 20 also requires a specific instruction to arm the weapon from the watchdog controller 14 before the weapon can be armed or otherwise prepared for discharge. The safe/arm signals can be encrypted to prevent any tampering. Any message, other than the arm code, disarms the system and puts it into a safe state.

A system 10 provided in accordance with the invention generally operates in the following manner. First, the operator will confirm via the pressure gauge or pressure indicator 100 that no pressure is in the pneumatic control system 80. The operator will then ensure that the manual cutoff valve 94 is closed and that the manual vent valve 96 is open. The power switch 70 (FIG. 1) will be turned on and the watchdog processor 14 will power up. Only the watchdog processor power will be provided at this time. If power is evident in other elements of the system, the startup sequence will be aborted to check the integrity of the system. At this point the operator will ensure that there is pressurized gas for the system in the supply 90, close the vent valve 96 and open the manual cutoff valve 94. The operator will then retreat to a safe area removed from the weapon system 10. The operator will command the watchdog processor 14 to power up the system controller 24 by means of the remote input device 16.

The system 10 then begins its automatic operation. At this point the weapon and the control system 10 are still in a safe state and the weapon cannot discharge. The watchdog processor 14 checks via a weapon status input whether the weapon 12 is ready to fire (for example, a round is loaded in a firing chamber or an igniter is activated to engage an explosive), and if the weapon 12 is ready to fire the watchdog processor 14 issues a warning and blocks further action until the weapon 12 is returned to a safe state where it cannot fire.

If the weapon 12 is not ready to fire, the watchdog processor 14 confirms receipt of a remote heartbeat signal from the remote source 16, which includes a deadman switch. Any interruption in this signal leads to an automatic interruption of power to the safe/arm controller 20 and a return to the safe state. The watchdog controller 14 will then power up the weapon control system processor 24. The watchdog controller 14 will wait until receiving the weapon system controller heartbeat before providing a safe/arm signal to the safe/arm controller 20. The weapon system processor 24 then provides a heartbeat signal to the watchdog controller 14 to confirm its operation. Any interruption in the weapon system processor's heartbeat signal also will lead to a shutdown and a return to a safe state.

An interruption of either heartbeat signal can occur when there is a lack of any signal, an absence of a signal after a predetermined time, an unexpected change in the signal, etc. The events that constitute an interruption and responses to an interruption are predetermined.

The weapon system processor 24 then closes the vent valve 68 and opens the cutoff valve 102 to permit pressure to build in the pneumatic control system 80. The watchdog controller 14, having received the weapon control system heartbeat signal closes the vent valve 64 and opens the cutoff valve 62. Once the pneumatic control system 80 is pressurized, power is provided to the safe/arm controller 20, which begins a delay timer. The delay time is used in the exemplary system 10 to insure overall system stability. At the end of the delay time the safe/arm controller 20 can accept an arm signal to close the switch 22 that allows the weapon control system processor 24 to arm the weapon such as by loading a round in a firing chamber. The weapon control system processor 24 can then discharge the weapon at the appropriate time.

The safe/arm controller 20 ensures that the trigger actuator circuit cannot be pressurized until a predetermined delay time after pressurization of the pneumatic control system 80. The trigger actuator circuit is armed on command from the watchdog controller 14, and is disarmed on any non-arm command from the watchdog controller 14. If the watchdog controller 14 detects a failure or an out-of-sequence command, the watchdog controller 14 will send a disarm or safe code signal to the safe/arm controller 20, depressurize the pneumatic control system 80, disconnect the electrical power to the safe/arm controller 20 and the weapon system processor 24, thereby moving the system 10 to a safe state, one which requires a manual restart by an operator.

As noted above, the safe/arm controller 20 includes an antifuse, and controls a switch 22 interposed between the weapon system processor 24 and the means for discharging the weapon 12. When the switch 22 is open, the communication path does not extend between the weapon system processor 24 and the weapon 12, thereby preventing activation of the weapon 12 and keeping it in a safe state. If power to the safe/arm controller 20 is interrupted, the switch 22 is opened. If the control lines between a sensor and the safe/arm controller 20 are interrupted, the safe/arm controller 20 opens the switch 22. Only if the watchdog controller 14 receives both a series of status inputs in a predetermined sequence and a safe/arm signal permitting the weapon 12 to be discharged (an "arm" signal) does the watchdog controller 14 instruct the safe/arm controller 20 to close the switch 22, thereby permitting the remote weapon system processor 24 to access the weapon 12. The safe/arm signal also can provide a "safe" signal, whereby the safe/arm controller 20 would open the switch 22 and thereby block all signals from the remote weapon system processor 24 from activating the weapon 12. The safe signal also may cause the system 10 to disarm the weapon 12, such as by removing a round from the firing chamber, for example.

During system shutdown, the weapon control system processor 24 closes the cutoff valve 102 and opens the vent valve 68, thereby venting pressure in the pneumatic control system 80. The watchdog controller 14 also closes its cutoff valve 62 and opens its vent valve 64. The pressure gauge 100 can also include a pressure indicator that can be seen from a distance so that the operator, located at a safe distance from the weapon, can visually determine whether or not the pneumatic control system 80 is pressurized. A flag, for example, may be raised when the system is pressurized. During shutdown, once the pneumatic control system 80 is vented, the pressure indicator flag would then lower or retract so that the operator again would have a visual indication that the pneumatic control system 80 has been depressurized. The weapon control system processor 24 then begins a controlled shutdown, and the watchdog controller 14 powers down the weapon system processor 24. After a predetermined delay, the system 10 may now be approached by the operator, the manual vent valve 96 opened, the manual cutoff valve 94 closed, and the supply of pressurized gas 90 can be removed from the system 80, thereby ensuring the overall system 10 safety.

In the event of an emergency shutdown, initiated by either a remote safe signal to the watchdog 14, or by the watchdog controller 14 detecting a lack of a weapon control system 24 heartbeat or lack of a remote heartbeat signal from the remote input device 16, the watchdog controller 14 will close the cutoff valve 62 and open the vent valve 64, and then power down the weapon control system processor 24. The operator can approach the system 10 after the pressure indicator flag lowers or retracts. In the absence of power to either of the watchdog controller 14 or the weapon control system processor 24 at least one of the cutoff valves 62 and 102 will close, and at least one of the vent valves 64 and 68 will open, thereby depressurizing the system 80 and preventing activation of the weapon.

Thus, a method for remotely controlling a weapon system includes the following steps: (i) providing a safe state where the weapon cannot discharge; (ii) moving the weapon from a safe state to a ready-to-fire state only if a predetermined sequence of events occurs in the proper order; and (iii) discharging the weapon only in the ready-to-fire state. The moving step (ii) requires both that the weapon system processor 24 and the safe/arm controller 20 are in predetermined operational states and receipt of a remote weapon arm signal. The safe/arm controller 20 in an operational state when power is provided to the system 10, a status signal is received from the remote source 16 and a status signal is received from a weapon system processor 24, and power is provided to a watchdog controller 14, a safe/arm processor 20, and the weapon system processor 24.

A method for remotely enabling a weapon to discharge includes the following sequence of steps: (i) receiving a status signal from a remote source; (ii) determining that the weapon is in a safe condition; (iii) receiving a status signal from a weapon system processor; (iv) receiving a safe/arm signal from a remote source; and (v) transmitting the safe/arm signal to a safe/arm controller. This method optionally may include the following step after the transmitting step (v): (vi) changing the state of a switch 22 from a safe state to an arm state to close a communication path between the weapon system processor 24 and the weapon 12, thereby allowing the weapon system processor 24 to discharge the weapon 12.

In this system 10, if either (a) there is an interruption in either (i) the status signal from the remote source 16 or (ii) the status signal from the weapon system processor 24 or (b) a safe/arm signal is received from the remote 16 source that requests a safe state, then the state of the switch 22 is changed to a safe state, thereby preventing communication between the weapon system processor 24 and the weapon 12.

The system provided by this invention can be used with armed unmanned vehicles either in the air, on the ground, or in the water, (any of which can be referred to as robots), armed stationary robotic or other semi/fully automated platforms, remotely operated weapon systems mounted on manned vehicles, and in use for defeating mines and improvised explosive devices.

In summary, the present invention provides a system and method with one or more of the features set forth in the following clauses.

A. A system for remotely enabling and disabling a weapon, comprising: a watchdog controller adapted to receive a safe/arm command from a remote source and to transmit the safe/arm command if predetermined conditions are satisfied; a safe/arm controller adapted to receive the safe/arm command from the watchdog controller and to transmit a control signal to enable communication between a weapon system processor and the weapon if a predetermined series of input signals are received in a predetermined sequence; and a switch in a communication path between the weapon system processor and the weapon; where the safe/arm controller closes the switch and enables communication only when the safe/arm controller receives an arm signal and receives the predetermined series of input signals in the predetermined sequence.

B. A system as set forth in clause A or any other clause based on clause A, further comprising a remote input device to send a safe/arm command to the watchdog controller.

C. A system as set forth in clause A or any other clause based on clause A, further comprising a remote weapon system processor adapted to output a status signal to the watchdog controller and to output a control signal to control the weapon.

D. A system as set forth in clause A or any other clause based on clause A, where the safe/arm controller includes a hardwired antifuse circuit.

E. A system as set forth in clause A or any other clause based on clause A, where the safe/arm controller is a preprogrammed antifuse circuit.

F. A system as set forth in clause A or any other clause based on clause A, where the safe/arm controller includes an antifuse programmable gate array.

G. A system as set forth in clause A or any other clause based on clause A, where the safe/arm signal is an electronic signal and the watchdog controller receives the safe/arm signal from the remote source wirelessly.

H. A system as set forth in clause A or any other clause based on clause A, where the watchdog controller is programmable such that its programming can change.

I. A system as set forth in clause A or any other clause based on clause A, where the watchdog controller is adapted to receive predetermined conditions that include one or more of a status signal from a remote source and from the weapon system processor, a power signal, a weapon status signal, and a safe/arm signal from a remote source.

J. A system as set forth in clause A or any other clause based on clause A, where the communication path between the remote weapon system processor and the weapon is pneumatic.

K. A system as set forth in clause A or any other clause based on clause A, where the remote weapon system processor outputs include a pressure signal to open a normally-closed switch and a pressure signal to close a normally-open switch, and command signals to discharge a weapon by opening a pair of normally-closed switches.

L. A system as set forth in clause A or any other clause based on clause A, where the remote weapon system processor has a power supply that is independent of the power supply for the watchdog controller and the power supply for the safe/arm controller.

M. A system as set forth in clause A or any other clause based on clause A, where a command to discharge a weapon cannot be communicated to the weapon unless the safe/arm controller provides a signal permitting the command signals from the remote weapon system to pass.

N. A system as set forth in clause A or any other clause based on clause A, where the switch includes both a pair of transistors and a pair of normally-open switches that are closed by an "arm" signal from the remote weapon system processor.

O. A system as set forth in clause A or any other clause based on clause A, where the switch is normally open, thereby blocking signals from the remote weapon system processor to the weapon.

P. A system as set forth in clause A or any other clause based on clause A, where the switch includes at least two switches, one of which is normally open and one of which is normally closed, and both the normally-open switch must be closed and the normally-closed switch must be opened to transmit a control signal from the remote weapon system processor to the weapon.

Q. A system as set forth in clause A or any other clause based on clause A, comprising a pneumatic control circuit connected to the watchdog controller, the remote weapon system processor and the safe/arm controller.

R. A system as set forth in clause A or any other clause based on clause A, where the switch is pneumatic.

S. A method for remotely controlling a weapon system, comprising the following steps: providing a safe state where the weapon cannot discharge; moving the weapon from a safe state to a ready-to-fire state only if a predetermined sequence of events occurs in the proper order; and discharging the weapon only in the ready-to-fire state; where the moving step requires both that the weapon system processor and the safe/arm control system are in predetermined operational states and receipt of a remote weapon arm signal.

T. A method as set forth in clause S, where the control system is in an operational state when power is provided to the system, a status signal is received from the remote source and a status signal is received from a weapon system processor, and power is provided to a watchdog controller, a safe/arm processor, and the weapon system processor.

U. A method for remotely enabling a weapon to discharge, comprising the following sequence of steps: receiving a status signal from a remote source; determining that the weapon is in a safe condition; receiving a status signal from a weapon system processor; receiving a safe/arm signal from a remote source; and transmitting the safe/arm signal to a safe/arm controller.

V. A method as set forth in clause U or any other clause based on clause U, further comprising the following step after the transmitting step: changing the state of a switch from a safe state to an arm state to close a communication path between the weapon system processor and the weapon, thereby allowing the weapon system processor to discharge the weapon.

W. A method as set forth in clause U or any other clause based on clause U, where if either (a) there is an interruption in either (i) the status signal from the remote source or (ii) the status signal from the weapon system processor, or (b) a safe/arm signal is received from the remote source that requests a safe state, then the state of the switch is changed to a safe state, thereby preventing communication between the weapon system processor and the weapon.

Although the invention has been shown and described with respect to a certain illustrated embodiment or embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention.

We claim:

1. A system for remotely enabling and disabling a weapon, comprising:

a watchdog controller adapted to receive a safe/arm command from a remote source and to transmit the safe/arm command if predetermined conditions are satisfied;

a safe/arm controller adapted to receive the safe/arm command from the watchdog controller and to transmit a control signal if a predetermined series of input signals are received in a predetermined sequence;

a remote weapon system processor adapted to output a status signal to the watchdog controller and to output a control signal to control the weapon; and a switch in a communication path between the remote weapon system processor and the weapon;

where the safe/arm controller closes the switch and enables communication along the communication path only when the safe/arm controller receives an arm signal and receives the predetermined series of input signals in the predetermined sequence.

2. A system as set forth in claim 1, further comprising a remote input device to send a safe/arm command to the watchdog controller.

3. A system as set forth in claim 1, where the safe/arm controller includes a hardwired antifuse circuit.

4. A system as set forth in claim 1, where the safe/arm controller is a preprogrammed antifuse circuit.

5. A system as set forth in claim 1, where the safe/arm controller includes an antifuse field-programmable gate array.

6. A system as set forth in claim 1, where the safe/arm command is an electronic signal and the watchdog controller receives the safe/arm command from the remote source wirelessly.

7. A system as set forth in claim 1, where the watchdog controller is programmable such that its programming can change.

8. A system as set forth in claim 1, where the watchdog controller is adapted to receive predetermined conditions that include one or more of a status signal from a remote source and from the weapon system processor, a power signal, a weapon status signal, and a safe/arm signal from a remote source.

9. A system as set forth in claim 1, where the communication path between the remote weapon system processor and the weapon is pneumatic.

10. A system as set forth in claim 1, where the remote weapon system processor outputs include a pressure signal to open a normally-closed switch and a pressure signal to close a normally-open switch, and command signals to discharge a weapon by opening a pair of normally-closed switches.

11. A system as set forth in claim 1, where the remote weapon system processor has a power supply that is independent of the power supply for the watchdog controller and the power supply for the safe/arm controller.

12. A system as set forth in claim 1, where a command to discharge a weapon cannot be communicated to the weapon unless the safe/arm controller provides a signal permitting the command signals from the remote weapon system processor to pass.

13. A system as set forth in claim 1, where the switch includes both a pair of transistors and a pair of normally-open switches that are closed by an "arm" signal from the remote weapon system processor.

14. A system as set forth in claim 1, where the switch is normally open, thereby blocking signals from the remote weapon system processor to the weapon.

15. A system as set forth in claim 1, where the switch includes at least two switches, one of which is normally open and one of which is normally closed, and both the normally-open switch must be closed and the normally-closed switch must be opened to transmit a control signal from the remote weapon system processor to the weapon.

16. A system as set forth in claim 1, comprising a pneumatic control circuit connected to the watchdog controller, the remote weapon system processor and the safe/arm controller.

17. A system as set forth in claim 1, where the switch is pneumatic.

* * * * *